US009068542B2

(12) United States Patent
Graner et al.

(10) Patent No.: US 9,068,542 B2
(45) **Date of Patent: *Jun. 30, 2015**

(54) FUEL INJECTOR

(75) Inventors: Juergen Graner, Sersheim (DE); Martin Maier, Moeglingen (DE); Bernd Rieg, Kawasaki (JP); Volker Sohm, Seoul (KR); Juergen Lander, Stuttgart (DE); Takuya Mizobe, Ludwigsburg (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/823,893

(22) PCT Filed: Jul. 26, 2011

(86) PCT No.: PCT/EP2011/062795

§ 371 (c)(1),
(2), (4) Date: Sep. 25, 2013

(87) PCT Pub. No.: WO2012/034758

PCT Pub. Date: Mar. 22, 2012

(65) Prior Publication Data

US 2014/0008468 A1 Jan. 9, 2014

(30) Foreign Application Priority Data

Sep. 16, 2010 (DE) ..... 10 2010 040 914

(51) Int. Cl.
*F02M 51/06* (2006.01)
*F02M 63/00* (2006.01)
*H01F 7/16* (2006.01)

(52) U.S. Cl.
CPC ..... *F02M 51/0625* (2013.01); *F02M 51/0682* (2013.01); *F02M 63/0019* (2013.01); *F02M 2200/08* (2013.01); *F02M 2200/9061* (2013.01); *H01F 7/1607* (2013.01)

(58) Field of Classification Search
USPC ..... 239/569–586
See application file for complete search history.

(56) References Cited

U.S. PATENT DOCUMENTS

| | | | |
|---|---|---|---|
| 4,662,567 | A | 5/1987 | Knapp |
| 4,944,486 | A | 7/1990 | Babitzka |
| 4,996,764 | A | 3/1991 | Babitzka |
| 5,069,834 | A | 12/1991 | Babitzka |

(Continued)

FOREIGN PATENT DOCUMENTS

| | | |
|---|---|---|
| CN | 101105165 | 1/2008 |
| DE | 34 45 405 | 6/1986 |

(Continued)

OTHER PUBLICATIONS

International Search Report, PCT International Application No. PCT/EP2011/062025, dated Oct. 5, 2011.

*Primary Examiner* — Len Tran
*Assistant Examiner* — Adam J Rogers
(74) *Attorney, Agent, or Firm* — Kenyon & Kenyon LLP

(57) ABSTRACT

A fuel injector for fuel injection systems of internal combustion engines. The valve includes an electromagnetic actuating element which has a solenoid, a solid core, an external magnetic circuit component, and a movable armature for activating a valve closing member which cooperates with a valve seat surface provided on a valve seat member. The valve has extremely small outer dimensions. By optimizing the dimensions of the electromagnetic circuit, the outer diameter of the external magnetic circuit component in the peripheral area of the solenoid is 10.5 mm<$D_M$<13.5 mm. This increases the flexibility in installing fuel injectors having different valve lengths, which are made possible due to the special modular design. The valve is suitable as a fuel injector in particular for use in fuel injection systems of mixture-compressing, spark ignition internal combustion engines.

10 Claims, 3 Drawing Sheets

(56) References Cited

U.S. PATENT DOCUMENTS

| | | | |
|---|---|---|---|
| 5,127,585 | A | 7/1992 | Mesenich |
| 5,330,153 | A | 7/1994 | Reiter |
| 6,076,802 | A | 6/2000 | Maier |
| 6,299,079 | B1 | 10/2001 | Noller et al. |
| 7,344,093 | B2 | 3/2008 | Yamamoto et al. |
| 2006/0249601 | A1 | 11/2006 | Thoemmes |

FOREIGN PATENT DOCUMENTS

| | | |
|---|---|---|
| DE | 38 25 134 | 1/1990 |
| DE | 197 39 150 | 3/1999 |
| DE | 103 32 348 | 2/2005 |
| DE | 10 2004 062 191 | 8/2005 |
| EP | 0 387 179 | 9/1990 |
| EP | 1 878 908 | 1/2008 |
| JP | 3505769 | 12/1991 |
| JP | 7-197867 | 8/1995 |
| JP | 2002 048031 | 2/2002 |
| JP | 2002-531751 | 9/2002 |
| JP | 2005-233048 | 9/2005 |
| JP | 2005-282564 | 10/2005 |
| JP | 2006-526106 | 11/2006 |
| JP | 2009-108805 | 5/2009 |
| WO | WO 91/11605 | 8/1991 |
| WO | WO 99/66196 | 12/1999 |

FUEL INJECTOR

FIELD

The present invention is directed to a fuel injector.

BACKGROUND INFORMATION

A fuel injector is described in German Patent No. DE 38 25 134 A1 which includes an electromagnetic actuating element having a solenoid, an internal pole, and an external magnetic circuit component, and a movable valve closing member which cooperates with a valve seat associated with a valve seat member. The injector is enclosed by a plastic extrusion molding, which extends primarily in the axial direction and encloses the connector which acts as the internal pole, and the solenoid. Ferromagnetic fillers which conduct magnetic field lines are introduced into the plastic casing, at least in the area enclosing the solenoid. In this regard, the fillers enclose the solenoid in the peripheral direction. The fillers are fine-grained crushed particles of metals having soft magnetic properties. The small metal particles which are magnetically embedded in the plastic have a more or less globular shape, and are individually magnetically isolated and therefore have no metallic contact with one another, so that no effective magnetic field forms. However, the positive aspect of a very high electrical resistance which results is offset by an extremely high magnetic resistance which is reflected in a considerable loss of power, and which thus determines the overall unfavorable functional properties.

In addition, a fuel injector is described in German Patent No. DE 103 32 348 A1 has a relatively compact design. In this valve, the magnetic circuit is formed by a solenoid, a fixed internal pole, a movable armature, and an external magnetic circuit component in the form of a magnet pot. For a slim, compact design of the valve, multiple thin-walled valve sleeves are used which are utilized as a connector as well as a valve seat support and guide section for the armature. The thin-walled nonmagnetic sleeve extending within the magnetic circuit forms an air gap, via which the magnetic field lines pass from the external magnetic circuit component to the armature and the internal pole. A fuel injector having a comparable design is also illustrated in FIG. 1, and is explained in greater detail below for better understanding of the present invention.

Furthermore, a fuel injector is described in Japanese Patent Application No. JP 2002-48031 A which likewise is characterized by a thin-walled sleeve approach, the deep-drawn valve sleeve extending over the entire length of the valve and having a magnetic separation point in the magnetic circuit area in which the otherwise martensitic structure is interrupted. This nonmagnetic intermediate section is situated at the level of the area of the working air gap between the armature and the internal pole, and in relation to the solenoid in such a way that the most effective magnetic circuit possible is provided. Such a magnetic separation is also used to increase the dynamic flow range (DFR) compared to the conventional valves having conventional electromagnetic circuits. As a result, however, such designs entail significant added manufacturing costs. In addition, introducing such a magnetic separation having a nonmagnetic sleeve section results in a different geometric configuration compared to valves without a magnetic separation.

SUMMARY

A fuel injector according to an example embodiment of the present invention may have the advantage of a particularly compact design. The valve has an extremely small outer diameter, which heretofore was considered by experts in the field of intake manifold injectors for internal combustion engines to be impossible to manufacture with maximum functionality. Due to this very small dimensioning, the installation of the fuel injector may be devised in a much more flexible manner than thought possible heretofore. Thus, due to the modular design of the valve, the fuel injectors according to the present invention may be installed in a very compatible manner in a large variety of mounting holes of different vehicle manufacturers, having numerous "extended tip" variants, i.e., injector variants which vary in length without changes in the length of the valve needle or the valve sleeve. The sealing ring which rests on the external magnetic circuit component and seals with respect to the walls of the mounting hole on the intake manifold is easily displaceable.

The geometry of the example fuel injector is advantageously defined primarily under the criteria concerning the variables $q_{min}$, $F_F$, and $F_{max}$. To achieve the extremely small external dimensions of the magnetic circuit with full functionality, according to the example embodiment of the present invention, outer diameter $D_A$ of the armature is set at 4.0 mm$<D_A<$5.9 mm. In addition, wall thickness t of a thin-walled valve sleeve, at least in the area of a working air gap, i.e., in the lower core area and in the upper armature area, is 0.2 mm$<t<$0.6 mm. For such dimensioning according to the present invention, a zone having a magnetic flux density of $B<0.01$ T as a magnetic separation or having a magnetic flux density of $0.01\ T<B<0.15$ T as a magnetic throttle is advantageously provided in the area of the working air gap in the valve sleeve.

It is particularly advantageous that with the aid of the dimensioning of the example fuel injector according to the present invention, the dynamic flow range (DFR) may also be greatly increased compared to the DFR that is customary for the conventional injectors.

BRIEF DESCRIPTION OF THE DRAWINGS

Exemplary embodiments of the present invention are illustrated in simplified form in the figures and explained in greater detail below.

DETAILED DESCRIPTION OF EXAMPLE EMBODIMENTS

Figure 1:
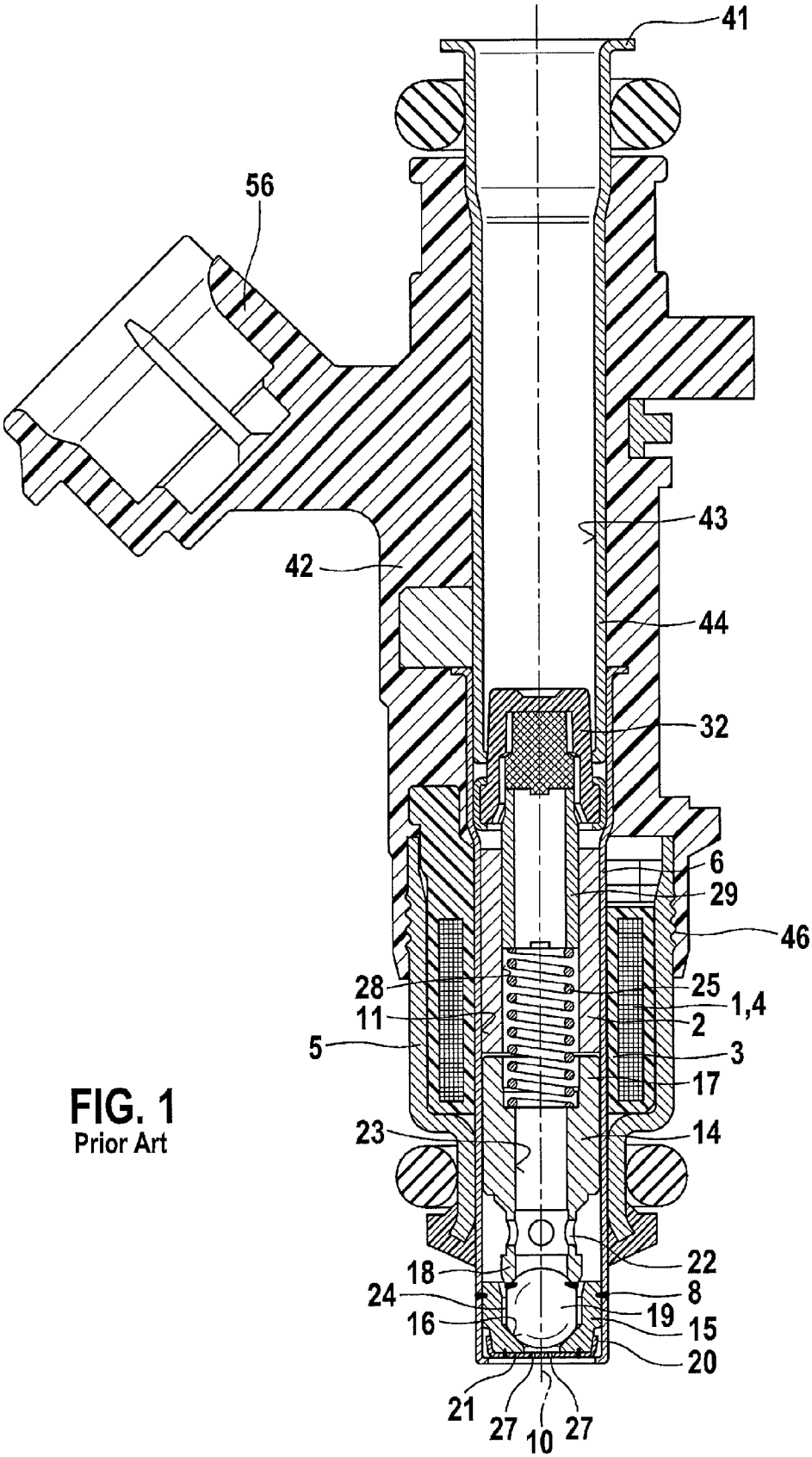
FIG. 1 Prior Art
FIG. 1 shows an electromagnetically activatable valve in the form of a conventional fuel injector.

For a better understanding of the present invention, FIG. 1 illustrates one example of an electromagnetically activatable valve in the form of a conventional fuel injector for fuel injection systems of mixture-compressing, spark ignition internal combustion engines.

The valve has a largely tubular core 2 which is enclosed by a solenoid 1 and which is used as an internal pole and in part for the flowthrough of fuel. Solenoid 1 is completely enclosed in the peripheral direction by an outer, for example ferromagnetic, valve casing 5 having a sleeve-shaped and stepped design, and which represents an external magnetic circuit which acts as an external pole. Solenoid 1, core 2, and valve casing 5 together form an electrically energizable actuating element.

While solenoid 1, embedded in a coil former 3, externally surrounds valve sleeve 6 with a winding 4, core 2 is introduced into an internal opening 11 in valve sleeve 6 which extends concentrically with respect to a valve longitudinal axis 10. Valve sleeve 6 has an elongated, thin-walled design. Opening 11 is used, among other things, as a guide opening for a valve needle 14 which is axially movable along valve longitudinal axis 10. Valve sleeve 6 extends in the axial direction, for example over approximately one-half the total axial extension of the fuel injector.

A valve seat member 15 which is affixed to valve sleeve 6 via a weld seam 8, for example, is also situated in opening 11 in addition to core 2 and valve needle 14. Valve-seat member 15 has a fixed valve seat surface 16 as the valve seat. Valve needle 14 is formed, for example, by a tubular armature 17, a likewise tubular needle section 18, and a spherical valve closing member 19, valve closing member 19 being fixedly connected to needle section 18 via a weld seam, for example. A spray orifice disk 21 having a pot shape, for example, and whose bent-over, circumferential retaining edge 20 is directed upwardly against the flow direction, is situated at the downstream end-face side of valve seat member 15. The fixed connection of valve seat member 15 and spray orifice disk 21 is established by a circumferential tight weld seam, for example. One or more transverse opening(s) 22 is/are provided in needle section 18 of valve needle 14, so that fuel flowing through armature 17 in an inner longitudinal hole 23 may exit to the outside and flow along valve closing member 19, for example along flat areas 24, to valve seat surface 16.

The injector is electromagnetically activated in a conventional manner. The electromagnetic circuit having solenoid 1, inner core 2, outer valve casing 5, and armature 17 is used for axially moving valve needle 14, and thus, for opening the injector against the elastic force of a restoring spring 25 which engages with valve needle 14, or for closing the injector. Armature 17 is oriented toward core 2 with the end facing away from valve closing member 19. Instead of core 2, for example a cover part, used as the internal pole, which closes the magnetic circuit may be provided.

Spherical valve closing member 19 cooperates with valve seat surface 16 of valve seat member 15, which tapers in the shape of a truncated cone in the flow direction, and which is formed in the axial direction downstream from a guide opening in valve seat member 15. Spray orifice disk 21 has at least one, for example, four, injection openings 27 which are formed by erosion, laser drilling, or punching, for example.

The insertion depth of core 2 into the injector is needed, among other things, for the lift of valve needle 14. For a nonenergized solenoid 1, one end position of valve needle 14 is determined by the contact of valve closing member 19 against valve seat surface 16 of valve seat member 15, while for an energized solenoid 1, the other end position of valve needle 14 results from the contact of armature 17 against the downstream core end. The lift is set by an axial displacement of core 2, which is subsequently fixedly connected to valve sleeve 6, corresponding to the desired position.

In addition to restoring spring 25, a setting element in the form of a setting sleeve 29 is inserted into a flow hole 28 of core 2, extending concentrically with respect to valve longitudinal axis 10, which is used to supply the fuel in the direction of valve seat surface 16. Setting sleeve 29 is used to set the spring pretension of restoring spring 25, which abuts on setting sleeve 29 and which at its opposite side is supported on valve needle 14 in the area of armature 17, the dynamic injection quantity also being set with the aid of setting sleeve 29. A fuel filter 32 is situated in valve sleeve 6, above setting sleeve 29.

The feed-side end of the valve is formed by a metal fuel inlet connector 41 which is enclosed by a plastic extrusion molding 42 which stabilizes, protects, and surrounds the metal fuel inlet connector. A flow hole 43 of a tube 44 of fuel inlet connector 41 which extends concentrically with respect to valve longitudinal axis 10 is used as the fuel inlet. Plastic extrusion molding 42 is extruded on, for example, in such a way that the plastic directly encloses portions of valve sleeve 6 and of valve casing 5. A secure seal is achieved, for example, via a labyrinth seal 46 at the periphery of valve casing 5. Plastic extrusion molding 42 also includes a co-molded electrical connecting plug 56.

Figure 2:
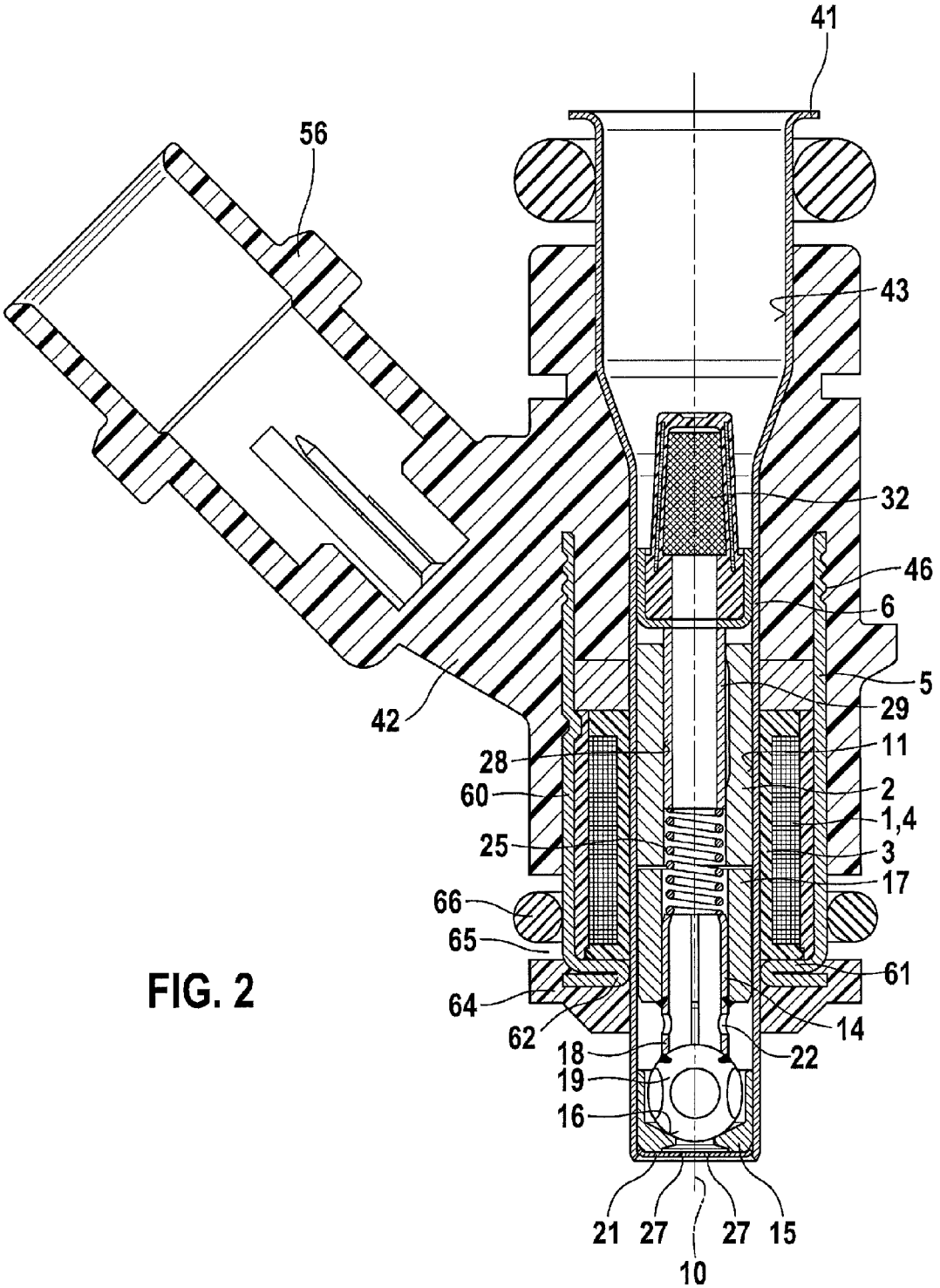
FIG. 2 shows a first example embodiment of a valve according to the present invention.

FIG. 2 shows a first exemplary embodiment of a fuel injector according to the present invention. Although not immediately apparent from FIGS. 1, 2, and 3 because the scale is not the same, the example fuel injectors according to the present invention are characterized by a very slim design, a very small outer diameter, and an extremely small overall geometric configuration. The dimensioning according to the example embodiments of the present invention is explained in greater detail below. In the present example, valve sleeve 6 has a design which extends over the entire length of the valve. External magnetic circuit component 5 has a cup-shaped design, and may also be referred to as a magnet pot. Magnetic circuit component 5 has a casing section 60 and a base section 61. A labyrinth seal 46, for example, is provided on the upstream end of casing section 60 of external magnetic circuit component 5, with the aid of which the seal with respect to plastic extrusion molding 42 which encloses magnetic circuit component 5 is achieved. Base section 61 of magnetic circuit component 5 is characterized, for example, by a fold 62, so that a double layer of folded-down magnetic circuit component 5 is present beneath solenoid 1. On the one hand, folded base section 61 of magnetic circuit component 5 is held in a defined position by a support ring 64 which is mounted on valve sleeve 6. On the other hand, support ring 64 defines the lower end of an annular groove 65 into which a sealing ring 66 is inserted. The upper end of annular groove 65 is defined by a lower edge of plastic extrusion molding 42. As the result of suitable dimensioning of the magnetic circuit, outer diameter $D_M$ of external magnetic circuit component 5 in the peripheral area of solenoid 1 is only 10.5 mm to 13.5 mm. Since casing section 60 extends cylindrically in the present embodiment of magnetic circuit component 5, at no point does magnetic circuit component 5 have a larger outer diameter than an outer diameter in the above-mentioned area. Sealing ring 66 is mounted directly on the outer periphery of external magnetic circuit component 5 in the area of casing section 60, so that the fuel injector, even with its sealing ring 66 which is radially externally pushed onto the magnetic circuit, is still introducible into mounting holes at the intake manifold having an inner diameter of 14 mm, for example. Sealing ring 66 may be provided in the peripheral area of external magnetic circuit component 5 at the largest outer diameter thereof.

To be able to achieve the smallest possible outer diameter of the magnetic circuit, primarily the internal components, such as core 2 used as the internal pole as well as armature 17, must also have correspondingly very small dimensions. Thus, in the redimensioning of the magnetic circuit, the minimum necessary size of the inner diameter of core 2 and armature 17 has been set at 2 mm to 2.5 mm. The inner diameters of the two components core 2 and armature 17 determine the inner flow cross section; it has been found that for an inner diameter of 2 mm, it is still possible to set the dynamic injection quantity with the aid of an internal restoring spring 25, without the tolerance of the inner diameter of restoring spring 25 influencing the static flow rate. Various variables and parameters play a role in the design of the magnetic circuit. It is thus optimal to continually reduce the minimum injection quantity $q_{min}$ to the greatest extent possible. However, it must in turn be ensured that elastic force $F_F$>3 N is maintained in order to guarantee the tightness of <1.0 $mm^3$/min, which is typical at the present time and also required in the future. In the present design, for a sealing diameter of d=2.8 mm, an elastic force of $F_F$>3 N corresponds to the static magnetic force of $F_{sm}$>5.5 N at a voltage $U_{min}$.

Maximum magnetic force $F_{max}$ is likewise an important variable for the design of a fuel injector having an electromagnetic drive. If $F_{max}$ is too small, i.e., is <10 N, for example, this may cause a so-called "closed stuck valve." This means that maximum magnetic force $F_{max}$ is too small to overcome the hydraulic adhesive force between valve closing member 19 and valve seat surface 16. In this case, the fuel injector would not be able to open despite being energized.

The example geometry of the fuel injector in accordance with the present invention has therefore been defined primarily under the criteria concerning the variables $q_{min}$, $F_F$, and $F_{max}$. In accordance with the present invention, in the optimization of the geometry of the magnetic circuit it has been found that outer diameter $D_A$ of armature 17 represents an important variable. The optimal outer diameter of armature 17 is 4.0 mm<DA<5.9 mm. This may be used to deduce the dimensioning of external magnetic circuit component 5, an outer diameter $D_M$ of magnetic circuit component 5 of 10.5 mm to 13.5 mm guaranteeing the full functionality of the magnetic circuit, even for a dynamic flow range (DFR) which is much higher compared to conventional injectors. In the embodiment according to FIG. 2 having a continuous thin-walled valve sleeve 6, the optimized dimensioning provides a wall thickness t for valve sleeve 6 of 0.2 mm<t<0.6 mm, at least in the area of the working air gap, i.e., in the lower core area and in the upper armature area. In the present embodiment, a zone having a magnetic flux density of 0.01 T<B<0.15 T as a magnetic throttle is provided in the area of the working air gap in valve sleeve 6. The design of the fuel injector having the above-described embodiment of valve sleeve 6 allows the lift to be set via a displacement of core 2 within valve sleeve 6.

Figure 3:
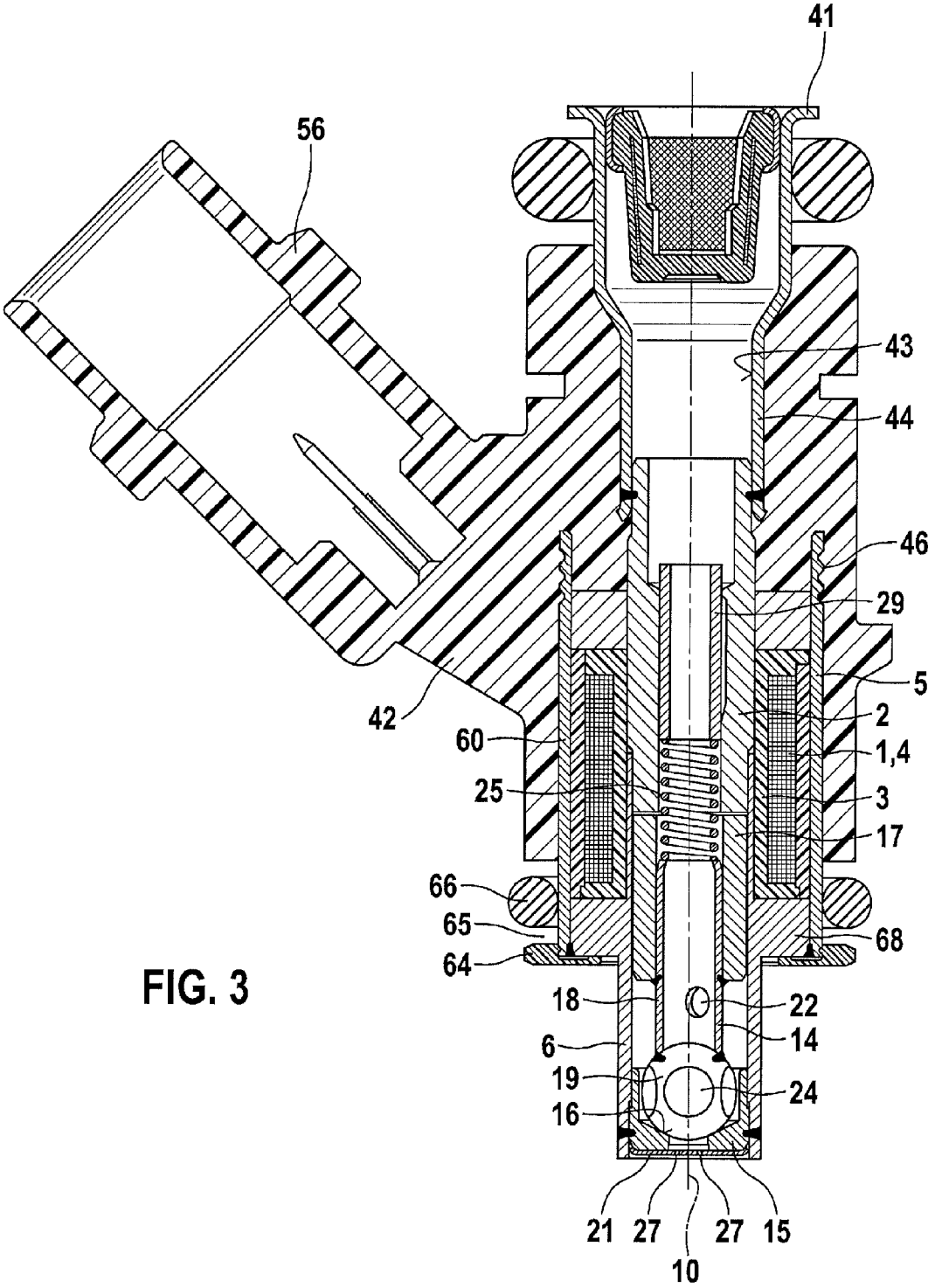
FIG. 3 shows a second example embodiment of a valve according to the present invention.

The geometric and dimensioning considerations stated above also similarly apply to a fuel injector in another design as shown in FIG. 3. This example fuel injector according to FIG. 3 differs from that according to FIG. 2 generally in the area of valve sleeve 6, of core 2, and of external magnetic circuit component 5. In the present case, valve sleeve 6 is shorter, and extends from the injection-side end of the valve only to the area of solenoid 1. Valve sleeve 6 is fixedly connected to tubular core 2 upstream from movable valve needle 14 including armature 17. This means that a setting of the lift via a displacement of core 2 within valve sleeve 6 is not possible here. Core 2 is once again affixed at its axially opposite end to a tube 44 of fuel inlet connector 41 which extends concentrically with respect to valve longitudinal axis 10. In the present embodiment, in this regard there is no continuous, thin-walled valve sleeve 6 over the entire length of the valve. In the area of the working air gap, valve sleeve 6 is now provided with a zone having a magnetic flux density of B<0.01 T as a magnetic separation. A base section has been dispensed with in the design of external magnetic circuit component 5, so that component 5 has a tubular shape. This is possible since valve sleeve 6 has a radially outwardly projecting flange-like collar 68, on whose outer periphery magnetic circuit component 5 abuts and which is affixed thereto with the aid of a circumferential weld seam, for example. Support ring 64 is designed as a flat, disk-shaped flange.

What is claimed is:

1. A fuel injector for a fuel injection system of an internal combustion engine, having a valve longitudinal axis, the fuel injector comprising:

an energizable actuator in the form of an electromagnetic circuit which has a solenoid, an internal core, an external magnetic circuit component, and a movable armature for activating a valve closing member which cooperates with a valve seat surface provided on a valve seat member; and a thin-walled valve sleeve which extends at least in an area of the electromagnetic circuit, wherein a wall thickness t of the valve sleeve, at least in an area of a working air gap in a lower core area and in an upper armature area, is 0.2 mm<t<0.6 mm;

wherein outer diameter $D_M$ of the external magnetic circuit component in a peripheral area of the solenoid is 10.5 mm<$D_M$ <13.5 mm, an outer diameter $D_A$ of the armature is 4.0 mm <$D_A$ <5.9 mm, and a zone having a magnetic flux density of B<0.01 T as a magnetic separation or having a magnetic flux density of 0.01 T<B<0.15 T as a magnetic throttle is provided in an area of the working air gap in the valve sleeve.

2. The fuel injector as recited in claim 1, wherein the thin-walled valve sleeve extends over an entire axial length of the fuel injector, and the internal core is displaceable within the valve sleeve in order to set lift, and a zone having a magnetic flux density of 0.01 T<B<0.15 T as a magnetic throttle is provided in the area of the working air gap in the valve sleeve.

3. The fuel injector as recited in claim 1, wherein the thin-walled valve sleeve extends from a injection-side end of the fuel injector to an area of the solenoid, the internal core being nondisplaceably situated on the valve sleeve, and a zone having a magnetic flux density of B<0.01 T as a magnetic separation being provided in the area of the working air gap in the valve sleeve.

4. The fuel injector as recited in claim 1, wherein a sealing ring is directly mounted on an outer periphery of the external magnetic circuit component.

5. The fuel injector as recited in claim 4, wherein the sealing ring in a peripheral area of the external magnetic circuit component is provided at a largest outer diameter thereof.

6. The fuel injector as recited in claim 5, wherein the fuel injector is configured so that it is introducible into mounting holes at an intake manifold having an inner diameter of 14 mm.

7. The fuel injector as recited in claim 1, wherein the external magnetic circuit component has a cup-shaped design having a casing section and a base section.

8. The fuel injector as recited in claim 7, wherein the base section is formed by a double-layer fold.

9. The fuel injector as recited in claim 3, wherein the internal core at its downstream end is connected to the valve sleeve.

10. The fuel injector as recited in claim 9, wherein the valve sleeve has a radially outwardly projecting flange-like collar on whose outer periphery the magnetic circuit component abuts and which is affixed thereto.

* * * * *